US006929142B2

(12) United States Patent
Gilbert et al.

(10) Patent No.: US 6,929,142 B2
(45) Date of Patent: Aug. 16, 2005

(54) REMOVABLE HATCH COVER FOR AN INTERNAL FLOATING ROOF MANWAY

(75) Inventors: David L. Gilbert, Laurel, MD (US); David G. Reed, Langhorne, PA (US)

(73) Assignee: AST Services LLC, Danbury, CT (US)

( * ) Notice: Subject to any disclaimer, the term of this patent is extended or adjusted under 35 U.S.C. 154(b) by 103 days.

(21) Appl. No.: 10/207,660

(22) Filed: Jul. 29, 2002

(65) Prior Publication Data

US 2004/0016755 A1 Jan. 29, 2004

(51) Int. Cl.[7] ..... B65D 88/36; B65D 88/42

(52) U.S. Cl. ..... 220/216; 220/218; 220/221; 220/227; 220/254.2; 220/254.3; 220/254.6; 220/580; 220/826

(58) Field of Search ..... 220/227, 254.4, 220/216, 254.2, 254.3, 826, 221, 218, 580, 578, 254.6

(56) References Cited

U.S. PATENT DOCUMENTS

| | | | | | |
|---|---|---|---|---|---|
| ,945,753 | A | | 1/1910 | Chamberlain | |
| 1,152,286 | A | * | 8/1915 | Brownson | 220/822 |
| 1,160,061 | A | * | 11/1915 | Friberg | 220/254.2 |
| 1,455,582 | A | | 5/1923 | Ford | |
| 1,592,524 | A | | 7/1926 | Holt | |
| 4,133,074 | A | | 1/1979 | Schacki | |
| 4,243,151 | A | * | 1/1981 | Bruening | 220/216 |
| 4,378,896 | A | | 4/1983 | Begnaud et al. | |
| 4,508,469 | A | | 4/1985 | Dumortier | |
| 4,535,908 | A | * | 8/1985 | Dabich | 220/484 |
| 4,781,388 | A | * | 11/1988 | Wohrl et al. | 277/355 |
| 4,804,113 | A | * | 2/1989 | Ciaccio | 222/142.1 |
| 4,921,120 | A | * | 5/1990 | Mizioch | 220/254.2 |
| 5,205,174 | A | | 4/1993 | Silverman et al. | |
| 5,423,446 | A | * | 6/1995 | Johnson | 220/216 |
| 5,627,800 | A | | 5/1997 | Kotler et al. | |
| 6,104,970 | A | | 8/2000 | Schmidt, Jr. et al. | |
| 6,629,687 | B1 | * | 10/2003 | Gage | 261/114.5 |

* cited by examiner

*Primary Examiner*—Lee Young
*Assistant Examiner*—Niki M. Eloshway
(74) *Attorney, Agent, or Firm*—David M. Rosenblum

(57) ABSTRACT

A hatch cover for deployment over a hatchway formed in a floating roof liquid storage tank permits rapid loading and unloading of inspection or maintenance equipment and minimizes vapor emissions from the tank. The portable hatch cover has two base plates movably connected at a hinge and each defining complementary recesses. A circular flange extends from the bottom surfaces of the base plates to seat the hatch cover in the hatchway. Two door panels are movably connected at hinges to the top surfaces of the base plates. When one or both of the door panels are opened, equipment may be loaded into the tank through the complementary recesses. When closed, the door panels cover the recesses in the base plates. Complementary notches in the door panels provide an opening through which equipment tubing or wiring may extend when the door panels are closed. A collar gasket optionally may be wrapped around the tubing or wiring as a further means to limit vapor emissions from the tank.

28 Claims, 3 Drawing Sheets

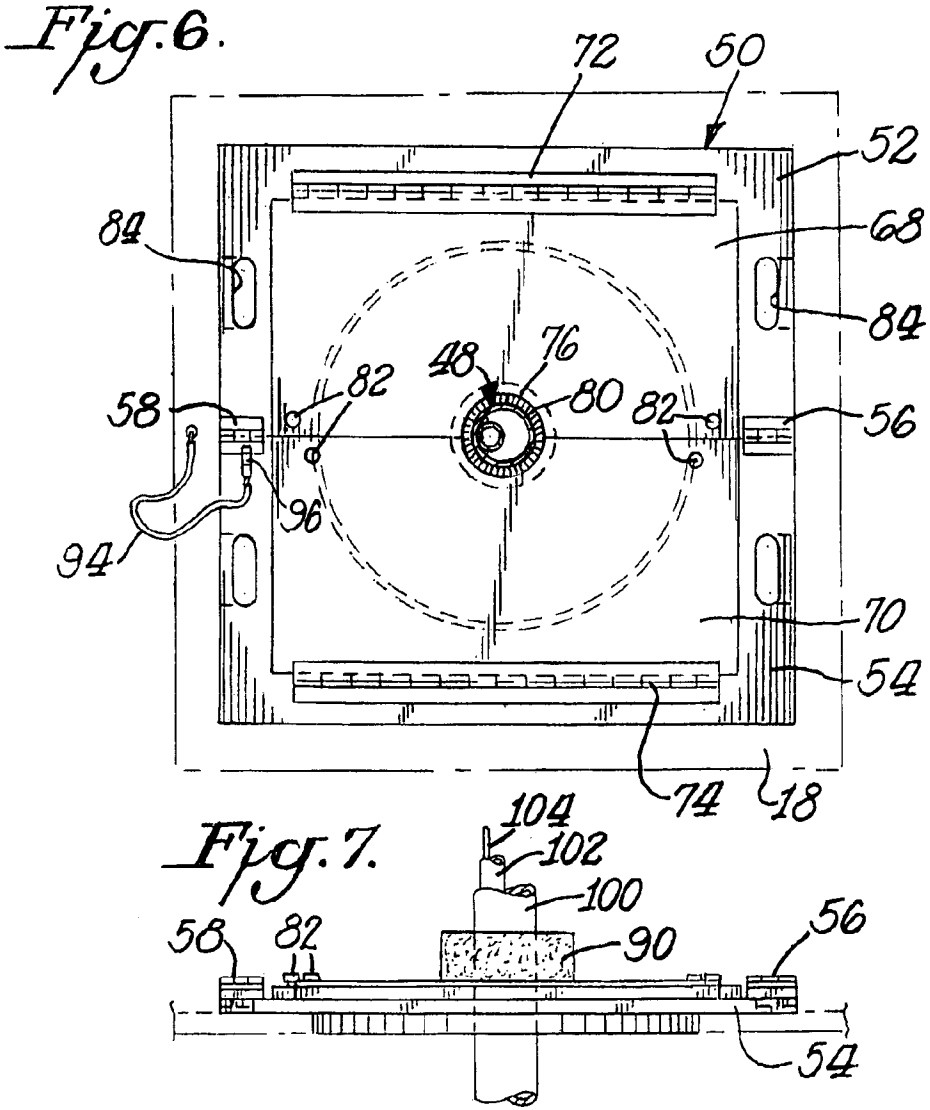
Fig. 6.
Fig. 7.
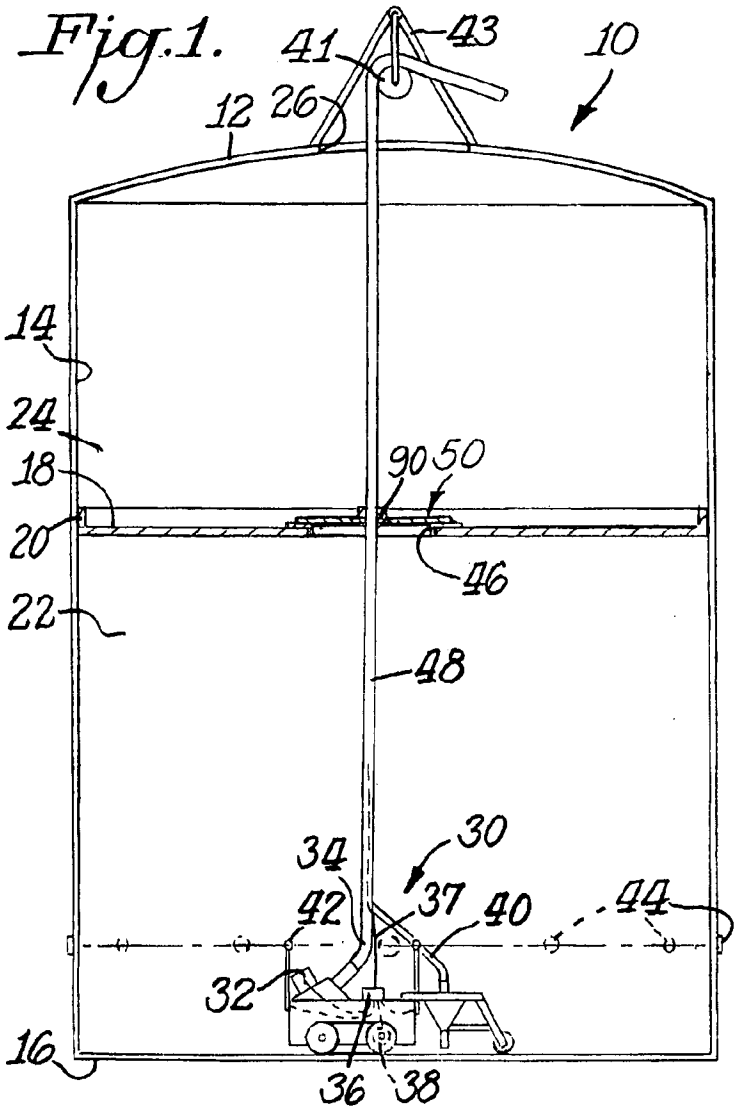
Fig. 1.

REMOVABLE HATCH COVER FOR AN INTERNAL FLOATING ROOF MANWAY

This invention relates to a hatchway cover that may be installed over a hatch or opening in a floating roof storage tank, wherein the cover provides a good seal against vapor leakage when closed, but can be opened to varying degrees to allow access to the internal storage volume of the tank for deploying equipment into the tank, such as a robotic inspection vehicle attached to one or more hoses and/or wire harnesses.

BACKGROUND OF THE INVENTION

A floating roof storage tank generally has a solid cylindrical outer wall covered by a solid dome-shaped roof. A floating roof is held within the volume defined by the outer wall and roof. The floating roof extends over the liquid contents held within the volume, and forms a vapor seal around the internal circumference of the cylindrical wall. The height within the tank at which the floating roof is positioned varies according to the amount of liquid being stored within the tank and the rate at which the liquid is pumped out of the tank.

Floating roof storage tanks generally are used to store flammable liquids, such as gasoline. A vapor space is formed inside the tank, between the floating roof covering the gasoline and the outer tank roof. Vapors emitted from the internal volume of the storage tank are collected in the vapor space to prevent significant amounts of vapor from being expelled to the atmosphere outside the tank. Environmental protection regulations restrict the amount of hydrocarbon vapors that may be released to the atmosphere. Air quality may be impacted adversely if hydrocarbon vapor emissions exceed permitted amounts.

Manual access to the internal volume of the tank is provided within the vapor space. One or more access ports or doorways are formed in the roof or outer wall of the tank. Persons may enter the vapor space through such access port(s) to service the tank, the floating roof and any equipment housed inside the tank.

Special precautions are taken when introducing equipment into the internal volume of the floating roof storage tank when the tank volume holds a flammable liquid, such as gasoline. Measures are taken to prevent sparks and associated combustion of flammable vapors. Measures are also taken to minimize the amount of time the seal between the flammable liquid and the vapor space above the floating roof is broken to prevent substantial amounts of flammable vapors from being emitted into the vapor space.

The floating roof frequently is provided with an opening or hatchway for access to the internal tank volume under the floating roof. That hatchway is covered with a hatch door that is sealed when closed to prevent unintended release of vapors. The hatch door also may be provided with grounding means to minimize the possibility of a spark.

Floating roof storage tanks are inspected at regular intervals to locate cracks, corrosion or other defects that might lead to tank failure. Environmental protection regulations specify the frequency and recommended procedures for inspecting tanks for structural integrity. One method involves introducing a remote controlled submersible vehicle into the tank while the tank remains in service. For example, U.S. Pat. No. 5,205,174 discloses a scavenger submersible vehicle that inspects the internal surfaces of a liquid filled tank using a video camera and/or ultrasound pulses. One or more umbilical hose(s) and wire harness(es) connect the remote-controlled vehicle to its power source and air or vacuum source, and further provide a link for transmitting navigation and inspection data from the vehicle to one or more computers located outside the tank.

While the vehicle readily may pass through the hatchway opening formed in a floating roof of a floating roof storage tank, the umbilical hose(s) and wire harness(es) extend through that opening and prevent re-positioning of the existing hatch cover over the hatchway opening. The submersible vehicle takes substantial time to traverse the inner surfaces of the tank to complete its inspection, and during that time, vapors from the tank can escape into the vapor space through the open hatchway. Thus, the industry seeks an improved hatch cover that can seal the hatchway opening while the inspection vehicle is deployed within the tank.

U.S. Pat. No. 1,592,524 discloses a floating roof tank with a cover plate that is pivotally secured to the upper floating wall. The cover plate has a recess to permit a pipe to pass therethrough. The tank is intended for storing oil, and no means are provided for minimizing vapor emissions. See also U.S. Pat. No. 945,753 showing a trap door with an opening for a pipe to pass therethrough.

SUMMARY OF THE INVENTION

A hatch cover for a liquid storage tank, most particularly a floating roof storage tank, has first and second base plates each defining holes or recesses that are complementary to one another. The complementary recesses form an opening through which inspection or maintenance equipment may be introduced into the volume of the tank as the hatch cover is installed over a hatchway in the floating roof while the tank holds a liquid, such as gasoline, oil, other petroleum products, jet fuel, chemicals, suspensions or slurries. Preferably the recesses are semi-circular, such that the recesses together form a generally circular opening with a diameter substantially comparable to the diameter of the circular hatchway. Alternatively, the recesses may have other shapes complementary to the hatchway opening, whether the opening is square, rectangular, hexagonal or octagonal or other regular or irregular geometric shape. The base plates are movably connected to one another, preferably by one or more hinges, such that the first base plate is movable from a folded position to an unfolded position. In the folded position, the top surface of the first base plate is over the top surface of the second base plate.

The hatch cover also includes first and second door panels that are movably connected to the base plates. In the preferred embodiment, the first door panel is movably connected to the first base plate and movable from a closed position over the top surface of the first base plate to an open position at an angle with respect to the top surface of the first base plate. The open position preferably is at an angle from about 90 degrees (i.e., substantially perpendicular) to about 180 degrees. In this preferred embodiment, the second door panel is movably connected to the second base plate and movable from a closed position over the top surface of the second base plate to an open position at an angle with respect to the top surface of the second base plate. Each door panel defines a cut out or notch, preferably arcuately- or semi-circularly-shaped, where the notch in the second door panel is complementary to the notch in the first door panel. In this preferred embodiment, the door panels are connected to the top surfaces of the base plates with hinges. Most preferably, the hinges are attached along an opposite edge of the door panels from the edge that has the cut out or notch formed therein.

When the first door panel is in its closed position, it substantially covers the hole or recess formed in the first base plate. When the second door panel is in its closed position, it substantially covers the hole or recess formed in the second base plate. However, the complementary notches in the first and second door panels define an opening for providing access into the storage tank that remains open even when the door panels are closed.

In a more preferred embodiment, one or more flanges extend from the bottom surface of the first base plate and adjacent to the first recess, and from the bottom surface of the second base plate and adjacent to the second recess. The flanges seat within the hatchway formed in a portion of a tank wall and along the inner periphery of said hatchway to hold the hatch cover in place over the hatchway.

In another more preferred embodiment, a multi-part brush seal extends along the first cut out or notch in the first door panel and along the second cut out in the second door panel. The brush seal engages any tubing or wiring to the equipment that extends through the opening during the inspection or maintenance of the tank. The brush seal does not impede movement of the tubing or wiring, but helps to limit vapor emissions. As a further step to limit vapor emissions, a gasket or collar is supplied to wrap around the exposed tubing or wiring and cover exposed portions of the opening formed by the first and second cut outs in the first and second door panels when the door panels are in their closed position.

The hatch cover is readily installed over a hatchway of a floating roof tank. The hatch cover may be folded in half at the hinge or hinges connecting the two base plates. When so folded the top surface of the first door panel contacts the top surface of the second door panel. In the folded position, the hatch cover is more readily stored, handled and transported to and from the installation site. Most preferably, one or more elongated openings are formed along the periphery of the base plates. The elongated openings serve as handles for gripping the base plates when folding, unfolding or transporting the hatch cover.

Any original hatch cover sealing the hatchway is removed to permit the hatch cover according to the invention to be installed. Upon installation, the hatch cover of the invention is unfolded so that the bottom surfaces of the base plates contact the upper surface of the floating roof around the hatchway. The flange(s) help to seat the cover over the hatchway. Then, one or both door panels may be opened to allow inspection or maintenance equipment to be introduced into the tank. The door panels each are movable independently. After the equipment is inside the tank, the door panels are closed. The opening defined by the complementary notches in the door panels then may be sealed. If one or more hoses or tubes or wires extend through the opening, a gasket or collar can be wrapped around such hoses, etc., to seal the space left in the opening. Preferably such gasket is formed from an open cell or closed cell foam, or alternatively from conformable rubber, plastic gel or a sandbag. After the inspection or maintenance work has been completed, the gasket is removed, and one or both door panels are opened to allow the equipment to be removed from the tank. Thereafter, the hatch cover can be folded and removed from the floating roof hatchway. The original hatch cover can be reinstalled into position to close the hatchway and prevent vapor emissions.

When intended for use in a floating roof storage tank where vapor emissions may cause a hazardous flammable condition, the hatch cover preferably is formed from materials that will not generate heat or sparks. In addition, the materials selected to form the hatch cover should not corrode or at least should not corrode excessively when exposed to the liquids stored in such tanks. Preferably, the base plates and door panels are formed from a material selected from the group consisting of: polyethylene, high density polyethylene (HDPE), ultra high molecular weight (UHMW) polyethylene, static dissipative UHMW polyethylene, aluminum, brass and carbon fiber composites. Metal components, such as aluminum to form the flanges, may be used, but care should then be taken to ground the entire hatch cover or at least such metal components to prevent sparks. Grounding may be accomplished with a conductive grounding cable attached at one end to one of the hinges or other metal components of the hatch cover and at its opposite end to a surface of the floating roof tank.

In a further embodiment of the invention, the hatch cover is designed to be permanently affixed over a hatchway of a floating roof storage tank. In such further embodiment, the door panels are movably connected, such as by hinges at their outer edges, to the upper surface of an internal floating roof. The door panels thus can be opened to expose the hatch so that equipment may pass into the internal tank volume through the hatch. When the door panels are closed over the hatch, the complementary cut outs or notches formed in the inner edges of the panels together form a preferably centrally located opening through which the umbilical cord to an inspection vehicle may pass. To completely close the hatch, the centrally located opening defined by the notches in the door panels also may be covered by a removable cover plate when the internal volume of the tank is not being accessed.

DESCRIPTION OF THE DRAWINGS

FIG. 1 is a schematic front elevational view of a floating roof storage tank into which a remote-controlled inspection vehicle has been deployed through a hatchway formed in the floating roof;

FIG. 6 is a top plan view of a hatch cover according to the invention in which both door panels are closed and showing a hose and wire harness extending through a recess in the hatch cover;

FIG. 7 is a front elevational view of the hatch cover shown in FIG. 6;

DESCRIPTION OF THE PREFERRED EMBODIMENTS

Figure 2:
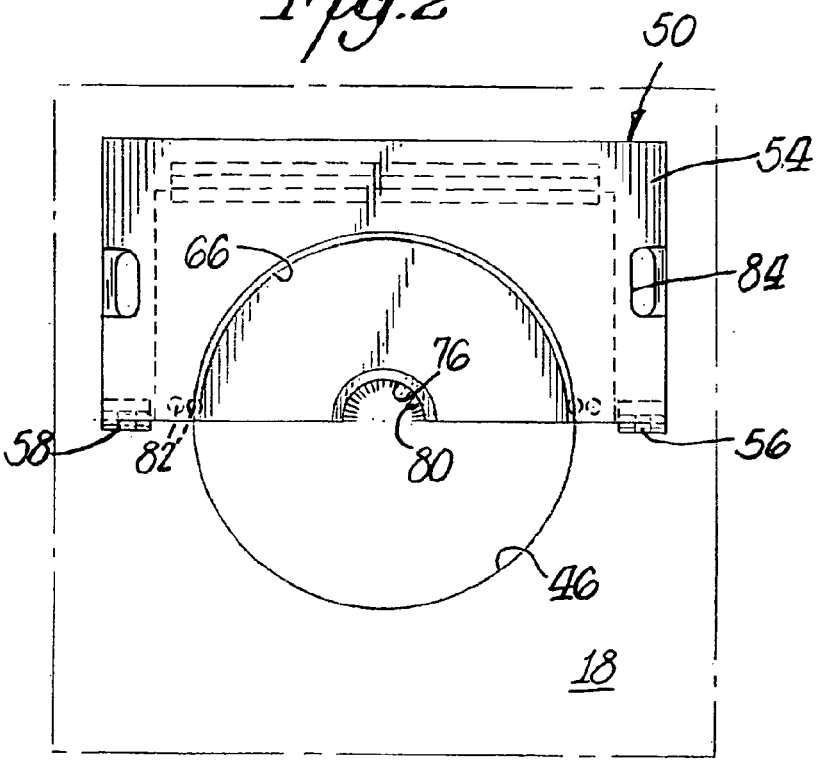
FIG. 2 is a top plan view of a hatch cover according to the invention in which the base has been folded along hinges.

Referring first to FIG. 1, a floating roof storage tank 10 has a sloped or dome-shaped roof 12 over a cylindrical side wall 14 and a floor 16. The floating roof storage tank 10 includes a floating roof 18 separating the liquid 22 within the liquid holding volume from the vapor space 24 above the liquid holding volume. A vapor seal 20 is formed at the edges of the floating roof 18 and contacts the internal wall of the side wall 14 to limit or prevent vapors from a volatile liquid stored in the tank from escaping the liquid holding volume under the floating roof 18.

For the tank shown in FIG. 1, a manway access port 26 through the roof 12 provides access to the vapor space 24 above the floating roof 18 for inspection and maintenance personnel. The tank may include one or a series of ladders (not shown) adjacent the internal side wall 14 of the tank leading from the access port 26 to the upper surface of the floating roof 18.

As shown in FIG. 1, an inspection vehicle 30 has been introduced into the liquid holding volume within the floating roof tank 10. The vehicle 30 traverses along the internal surface of the floor 16 to inspect the floor 16 for cracks or corrosion that could lead to tank failure. The vehicle 30 is equipped with a camera 32 to transmit video signals to a computer (not shown) located outside the tank 10. The vehicle 30 is motor 38 controlled and is provided an electronic control module 36 that is linked via cable 37 to a power source (not shown) located outside the tank 10. The vehicle 30 is also equipped with sensors (sonic transducers) 42 that communicate with transducers 44 mounted in an array on the outer surface of the side wall 14 of the tank 10. The sensors 42 and transducers 44 transmit and/or receive signals, and the data from the sensors is transmitted to a computer (not shown) located outside the tank, which computer analyzes such data to determine the position of the vehicle within the tank 10. The vehicle 30 is also provided with a blower and blower line 40 and a vacuum or suction line 34 that work independently or in combination to clear away debris from the internal surface of the floor 16 prior to inspecting that surface. Additional details about inspection vehicles and the means for operating and navigating such vehicles are shown in U.S. Pat. Nos. 5,205,174 and 5,627,800, the disclosures of which are incorporated herein by reference.

Tubing forming a suction line 34 in combination with a blower line 40 is joined with one or more cables for transmitting electric signals to the vehicle and transmitting electric signals back to the computer. The tubing and blower line and cable(s) together form an umbilical cord 48 that is installed over a pulley 41. As shown in FIG. 1, the pulley 41 is mounted to a tripod 43 installed over the outer roof 12. The umbilical cord 48 has sufficient strength to hold the vehicle 30 as it is lowered into the liquid holding volume inside the tank 10 and when it is lifted out of the liquid holding volume inside the tank 10.

A hatchway 46 is provided through the floating roof 18. The vehicle 30 preferably has a height and width that allow the vehicle to be passed through the hatchway 46 when the existing hatch cover provided on the floating roof 18 has been removed. Generally, the hatchways in floating roofs are circular with diameters ranging from 24 to 48 inches. Alternatively, the hatchways may have other geometric shapes, such as square, rectangular, hexagonal or octagonal, or other regular or irregular shape. The floating roofs most frequently are formed from aluminum.

It is also possible to install a second tripod with a pulley (not shown) on the floating roof 18 and over the hatchway 46 where the internal floating roof has sufficient stability to support such weight.

Environmental regulations limit the amount of time that the hatchway may be opened because vapors from volatile liquids stored within the tank are emitted into the vapor space causing a hazardous condition. Moreover, such emitted vapors may also be expelled from the tank into the atmosphere. However, when a tank is to be inspected using an inspection vehicle while the tank remains in service, i.e., with the liquid stored therein remaining in the liquid holding volume during the inspection, it is not possible to close the existing floating roof hatch cover. The umbilical cord between the inspection vehicle and the computer(s) and other equipment extends through the hatchway during the inspection. A hatch cover according to the invention permits the umbilical cord to extend therethrough during the inspection, and also limits or prevents vapor from escaping from the volatile liquid and into the vapor space above the floating roof.

Referring next to FIGS. 2 to 7, a hatch cover 50 according to the invention comprises a first base plate 52 and a second base plate 54 that are hingedly linked together by first and second hinges 56, 58. The first base plate 52 defines a semi-circular hole, opening or recess 60 therethrough. The second base plate 54 defines a semi-circular hole, opening or recess 62. The recesses 60, 62 in the first and second base plates 52, 54 are complementary, such that when the base plates 52, 54 extend in a fully open position where the plates are generally planar, the recesses 60, 62 together form a circular opening.

Preferably, the base plates 52, 54 are formed from high density polyethylene, static dissipative UHMW polyethylene, or aluminum, and the hinges are formed from aluminum, brass or a carbon fiber composite. It is preferred that the materials be selected not only for durability, but also for ease in handling and portability, and for reducing or minimizing the possibility of spark generation.

Figure 4:
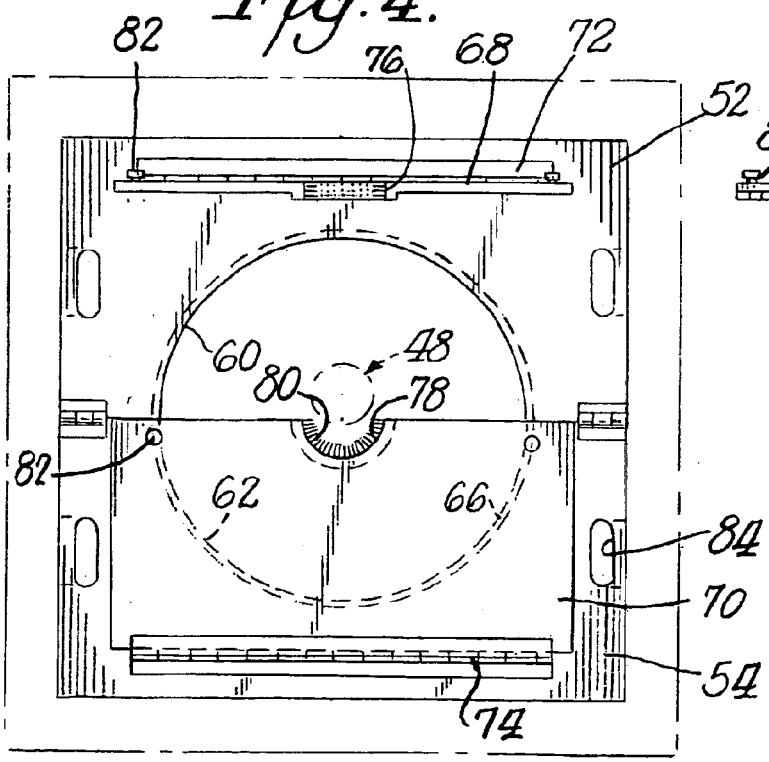
FIG. 4 is a top plan view of the hatch cover according to the invention in which one door panel has been opened at a hinge that attaches the door panel to the base.

A flange 64 extends outwardly and generally perpendicularly from the lower surface of the first base plate 52. The flange 64 extends generally around the semi-circular recess 60. A flange 66 extends outwardly and generally perpendicularly from the lower surface of the second base plate 54. The flange 66 extends generally around the semi-circular recess 62. The first and second flanges 64, 66 together form a seating ring when the first and second base plates 52, 54 are in a fully open position where the plates are generally planar. The first and second flanges 64, 66 help to seat the hatch cover over the hatchway in the floating roof tank. The flanges may be formed from aluminum, brass, plastic, rubber, carbon fiber composites or other non-sparking materials. A first door panel 68 is connected to the upper surface of the first base plate 52 with hinge 72. The first door panel 68 substantially covers the semi-circular recess 60 in the first base plate 52 when the first door panel 68 is in its closed position as shown best in FIG. 6. When the first door panel 68 is opened as shown in FIG. 4, the semi-circular recess 60 is exposed to provide access through approximately one-half of the hatchway. The first door panel 68 defines a semi-circular notch or cut out 76 along its side edge.

A second door panel 70 is connected to the upper surface of the second base plate 54 with hinge 74. The second door panel 70 substantially covers the semi-circular recess 62 in the second base plate 54 when the second door panel 70 is in its closed position, as shown in FIGS. 4 and 6. The second door panel 70 defines a semi-circular notch or cut out 78 along its side edge. The semi-circular notch 78 is complementary to the semi-circular notch 76 such that when the door panels are in their fully closed position over the openings in the base plates 52, 54, the notches form a generally circular opening that is axially aligned with the generally circular opening formed by the complementary recesses in the base plates.

The door panels 68, 70 preferably are fabricated from high density polyethylene, static dissipative UHMW polyethylene or aluminum, and the hinges preferably are formed from aluminum, brass or a carbon fiber composite. The components of the hatch cover preferably are fastened together with fasteners, such as brass or aluminum screws, bolts or rivets. Alternatively, if carbon fiber composites are used to form the base plates or the doors, fastening may be by epoxy or other adhesive sealing means. A brush seal 80 is provided along the edge of the semi-circular notches 74, 76. The brush seal has soft brass bristles, and is attached by sliding a retaining rim (not shown) of the brush seal into a groove (not shown) provided in a brush seal mounting flange (not shown). Alternative means to affix the brush seal to the inner periphery of the notches may be used.

Each door panel 68, 70 extends from a closed position in which its lower surface contacts the upper surface of the associated base plate 52, 54, respectively, to a fully open position in which the door panel is generally perpendicular to the upper surface of the associated base plate. For ease in opening, the door panels 68, 70 are provided with knobs or pulls 82.

For easier handling, preferably the base plates 52, 54 further define elongated openings 84 through the plate thickness and located along the peripheral edges to serve as handles.

As shown in FIGS. 6 and 7, the hatch cover 50 is installed over a hatchway in a floating roof tank. An umbilical cord to an inspection vehicle is formed as a combination of a suction line 100, a blower line 102, and a power line 104. The umbilical cord extends through the opening defined by the first and second base plates 52, 54 and through the opening defined by the first and second door panels 68, 70. A collar 90 is wrapped around the umbilical cord and rests over the top surfaces of the first and second door panels 68, 70. The collar 90 serves as a gasket and covers the gap(s), if any, between the outer surface of the umbilical cord and the brush seal 80 and the edges of the notches 76,78 in the door panels 68, 70 to prevent substantial emission of vapors from the tank through any gaps between the umbilical cord and the brush seal 90. The collar 90 preferably is formed from closed cell polyurethane foam, although other types of foam, such as open cell polyurethane foams with lower gas permeability, may also be used. Alternatively, the collar or gasket may be formed from conformable rubber, plastic or plastic gel or a sandbag. The collar 90 may be tightened around the umbilical cord with a belt clamp (not shown).

Figure 3:
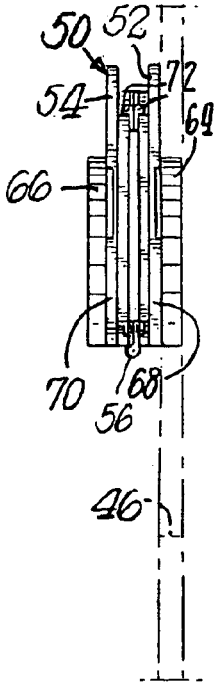
FIG. 3 is a right side elevational view of the hatch cover shown in FIG. 2.

Referring to FIGS. 2 and 3, the hatch cover 50 is shown in its folded position, in which the upper surface of the first door panel 68 lies flush and in contact with the upper surface of the second door panel 70. The hatch cover 50 has been folded at hinges 56, 58 such that the first base plate 52 is positioned under the second base plate 54, but is separated therefrom by first and second door panels 68, 70. In this folded position, the hatch cover 50 is readily stored and readily transported to a jobsite for installation over a hatchway 46.

When the hatch cover 50 is deployed over a hatchway 46, the flanges 64, 66 help to seat the cover over the hatchway and help to prevent substantial lateral movement of the cover. Preferably, the flanges 64, 66 contact the internal edges or internal periphery of the hatchway so as to help to seal the space between the cover and hatchway to minimize vapor emissions.

Figure 5:
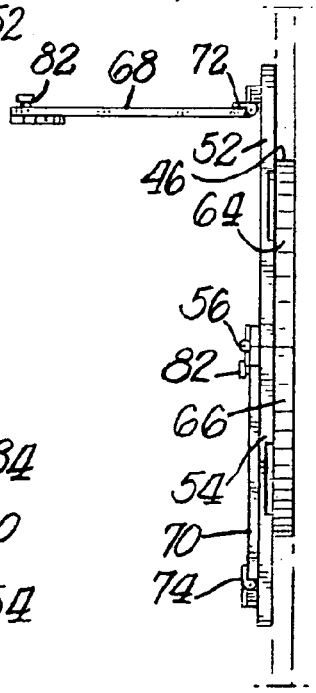
FIG. 5 is a right side elevational view of the hatch cover shown in FIG. 4.

As shown in FIGS. 4 and 5, a further advantage of the hatch cover 50 is that the first and second door panels 68, 70 can be opened independently. Thus, as shown in FIGS. 4 and 5, the first door panel 68 may be opened to allow access through the cover 50 and hatchway without removing the cover 50. Of course, when the hatch cover 50 is installed, the first and second door panels 68, 70 also may be both fully open (not shown) or both fully closed (FIGS. 6 and 7).

To prevent sparking, the cover 50 preferably is made using only conductive or static dissipative materials, and is grounded by connection to the floating roof 18 with a copper grounding cable 94 and brass clamp 96. The structure of the internal floating roof 18 then is in turn grounded to the outer wall 14 of the tank 10.

The hatch cover 50 of FIGS. 2 to 7 is readily deployed over a hatchway 46 in a matter of minutes. Moreover, the hatch cover 50 permits rapid introduction of a robotic inspection vehicle into a liquid filled tank. We have found that the hatch cover 50 may be deployed and the vehicle may be introduced into the tank within a total of about 15 minutes or less, which is well within EPA guidelines.

Figure 8:
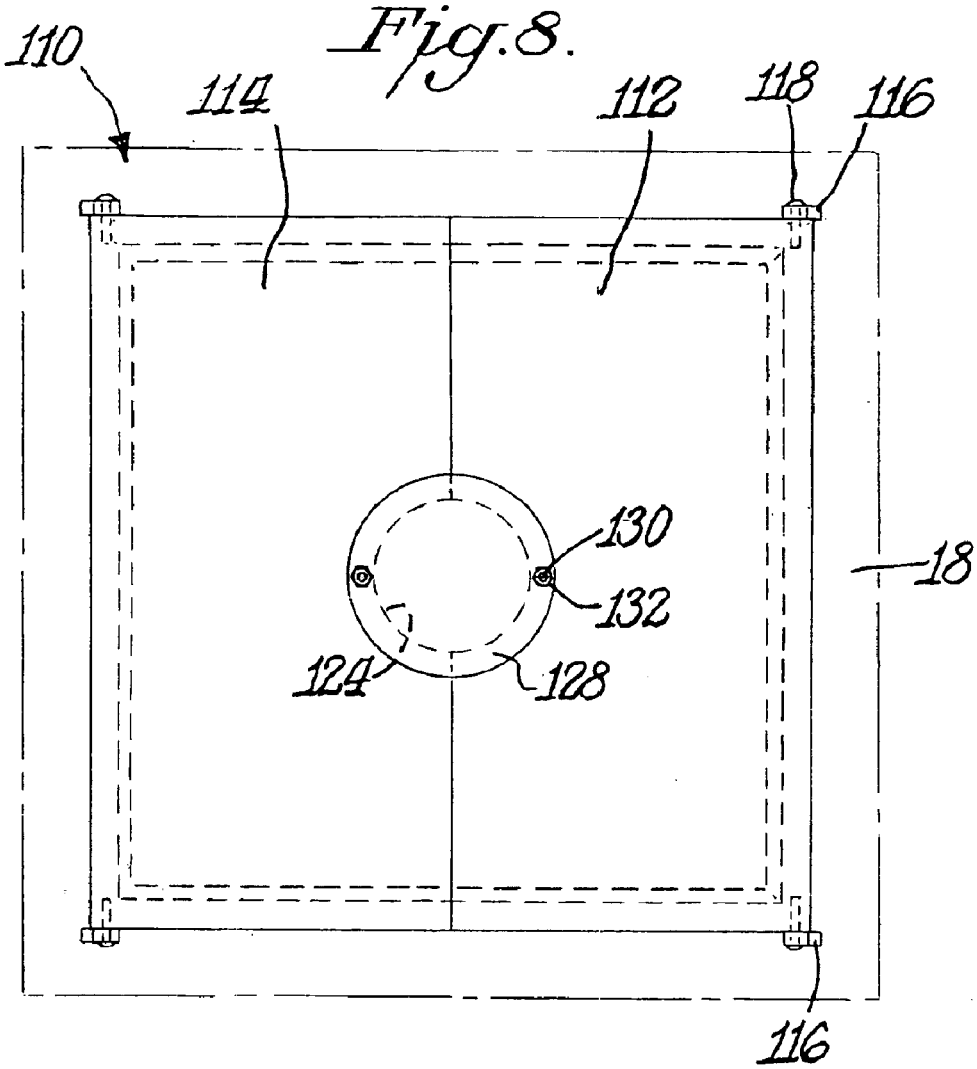
FIG. 8 is a top plan view of an alternative hatch cover according to the invention that is more permanently installed.
Figure 9:
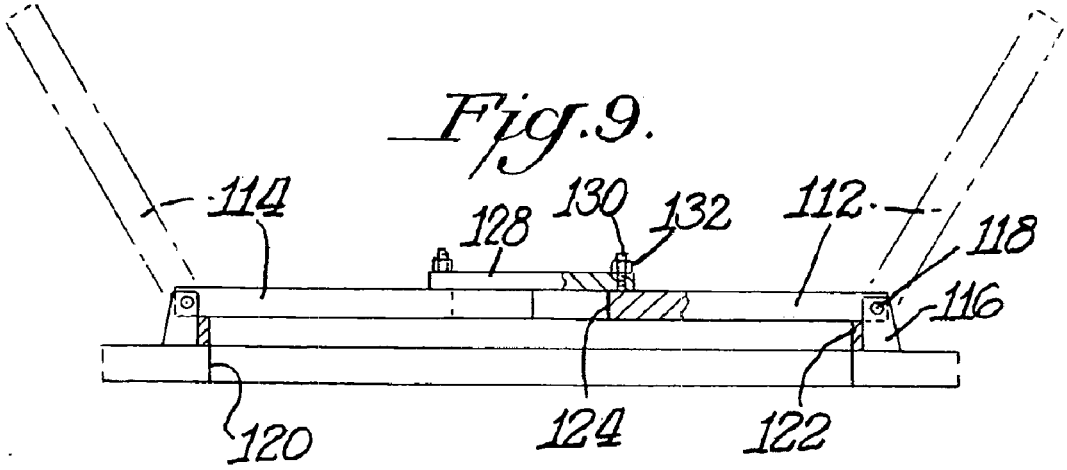
FIG. 9 is a side elevational view partially broken away of the hatch cover of FIG. 8 in which the door panels are shown first in a closed position and in phantom outline in an open position.

The hatch cover 50 shown in FIGS. 2 to 7 is intended to be portable for temporarily covering the hatchway in a floating roof tank. It is also possible to install a hatch cover as a more permanent cover over a hatchway of a floating roof tank. As shown in FIGS. 8 and 9, an alternate hatch cover 110 has a first door panel 112 and a second door panel 114 movably connected to the upper surface of the internal floating roof 18 with hinges 116 operatively attached with pivots 118. The pivots 118 engage the outer edges of each door panel. The inner edges of the first and second door panels 112, 114 define semi-circular notches or cut-outs 124. The door panels 112, 114 in FIG. 8 are shown as generally rectangular but for the cut-outs 124. The hatch opening 108 shown in FIG. 8 is generally square. As stated previously, the shape of the hatch opening may vary, and accordingly, the shape of the door panels to cover such opening may also vary.

The hatch opening 108 in FIGS. 8 and 9 is bordered by a perimeter ring or lip 122. When the door panels are in the closed position, the lower surfaces of the first and second door panels 112, 114 contact the upper surface of the perimeter ring 122 to cover the hatch opening 108. However, the complementary notches or cut-outs 124 in the door panels 112,114 form a circular opening to permit equipment, such as an umbilical cord or other wiring or tubing to an inspection vehicle, to pass therethrough. As discussed above with respect to the alternate embodiment of the invention, a collar may be wrapped around an umbilical cord to seal any gaps between the cord and the opening to prevent or minimize vapor emissions.

Referring to FIG. 8, the door panels 112, 114 are shown in a fully closed position over the hatch opening 108. In addition, a generally circular cover plate 128 is secured over the opening 124 with fasteners, such as a threaded bolt 130 and nut 132. The hatch opening 108 is thus fully covered, and the internal volume of the floating roof tank is sealed from entry.

To load equipment into the tank through the hatch opening 108, the cover plate 128 is removed, and the door panels 112, 114 are opened. In FIG. 9, the door panels 112, 114 are shown both in the closed position and in phantom outline in an open position.

The door panels 112, 114 and cover plate 128 preferably are fabricated from high density polyethylene, static dissipative UHMW polyethylene or aluminum, and the hinges preferably are formed from aluminum, brass or a carbon fiber composite. A brush seal (not shown) may also be provided along the edge of the semi-circular notches 124.

The invention has been illustrated by detailed description and examples of the preferred embodiments. Various changes in form and detail will be within the skill of persons skilled in the art. Therefore, the invention must be measured by the claims and not by the description of the examples or the preferred embodiments.

We claim:

1. A hatch cover for a liquid storage tank, comprising:

a first base plate having a top surface and a bottom surface and defining a first recess;

a second base plate having a top surface and a bottom surface and defining a second recess complementary to said first recess, said first base plate being movably connected to said second base plate such that the first base plate is movable from a folded position where the top surface of the first base plate is over the top surface of the second base plate to an unfolded position;

a first door panel having an upper surface and a lower surface, said first door panel being movably connected to said first base plate and movable from a closed position over the top surface of the first base plate to an open position at an angle with respect to the top surface of the first base plate, said first door panel defining a first notch; and a second door panel having an upper surface and a lower surface, said second door panel being movably connected to said second base plate and movable from a closed position over the top surface of the second base plate to an open position at an angle with respect to the top surface of the second base plate, said second door panel defining a second notch complementary to said first notch;

wherein said first door panel when in its closed position substantially covers the first recess in the first base plate, and said second door panel when in its closed position substantially covers the second recess in the second base plate, but the first and second notches define an opening for providing access into the storage tank.

2. The hatch cover of claim 1, further comprising a first flange extending from the bottom surface of the first base plate and adjacent to the first recess.

3. The hatch cover of claim 2, further comprising a second flange extending from the bottom surface of the second base plate and adjacent to the second recess.

4. The hatch cover of claim 3, wherein the first and second flanges seat within a hatchway formed in a portion of a tank roof or wall to hold the hatch cover over the hatchway.

5. The hatch cover of claim 3, wherein the first and second flanges seat within a hatchway formed in a portion of a floating roof in the tank to hold the hatch cover over the hatchway.

6. The hatch cover of claim 1, further comprising a first brush seal extending along the first notch in the first door panel.

7. The hatch cover of claim 6, further comprising a second brush seal extending along the second notch in the second door panel.

8. The hatch cover of claim 1, further comprising a gasket covering exposed portions of the opening formed by the first and second notches in the first and second door panels when the door panels are in their closed position.

9. The hatch cover of claim 8, wherein the gasket is formed from a material selected from the group consisting of: open cell foams, closed cell foams, conformable rubber, plastic gels and sandbags.

10. The hatch cover of claim 1, wherein when the first and second base plates are in a folded position, the upper surface of the first door panel contacts the upper surface of the second door panel.

11. The hatch cover of claim 1, wherein the first door panel is movable into an open position independently of the movement of the second door panel.

12. The hatch cover of claim 1, further comprising a hinge for movably connecting the first and second base plates.

13. The hatch cover of claim 1, further comprising a hinge for movably connecting the first door panel to the top surface of the first base plate.

14. The hatch cover of claim 1, further comprising a hinge for movably connecting the second door panel to the top surface of the second base plate.

15. The hatch cover of claim 1, further comprising a first hinge for movably connecting the first door panel to the top surface of the first base plate and a second hinge for movably connecting the second door panel to the top surface of the second base plate, wherein the first and second hinges are positioned generally parallel to one another when the base plates are in the unfolded position.

16. The hatch cover of claim 15, wherein the first door panel is movable to an open position substantially perpendicular to the first base plate.

17. The hatch cover of claim 15, wherein the second door panel is movable to an open position substantially perpendicular to the second base plate.

18. The hatch cover of claim 15, wherein the first hinge is attached to the first door panel along an opposite edge from the first notch.

19. The hatch cover of claim 15, wherein the second hinge is attached to the second door panel along an opposite edge from the second notch.

20. The hatch cover of claim 1, wherein when the first and second door panels are in the open position, the first and second recesses of the first base plate and second base plate respectively are uncovered for providing access into the storage tank.

21. The hatch cover of claim 1, wherein the first base plate defines one or more elongated openings along its periphery.

22. The hatch cover of claim 1, wherein the second base plate defines one or more elongated openings along its periphery.

23. The hatch cover of claim 1, wherein the first and second based plates are formed from a material selected from the group consisting of: polyethylene, high density polyethylene (HDPE), ultra high molecular weight (UHMW) polyethylene, static dissipative UHMW polyethylene, brass, aluminum and carbon fiber composites.

24. The hatch cover of claim 1, wherein the first and second door panels are formed from a material selected from the group consisting of: polyethylene, high density polyethylene (HDPE), ultra high molecular weight (UHMW) polyethylene, static dissipative UHMW polyethylene, brass, aluminum and carbon fiber composites.

25. The hatch cover of claim 1, wherein the first and second flanges are formed from a material selected from the group consisting of: aluminum, brass, carbon fiber composites, plastic and rubber.

26. A method for limiting vapor emissions from a floating roof storage tank when accessing the internal volume of the tank for inspection or maintenance, comprising:

installing a hatch cover according to claim 1 over the hatchway;

opening one or both of the first and second door panels;

introducing inspection or maintenance equipment into the tank through the hatchway while the hatch cover is over the hatchway; and returning the opened door panel or panels to a closed position.

27. The method of claim 26, further comprising sealing the opening with a gasket.

28. The method of claim 26, further comprising sealing around exposed tubing or wiring to the equipment in the tank that extends through the opening with a gasket.

* * * * *